United States Patent [19]

Frank et al.

[11] Patent Number: 4,817,309

[45] Date of Patent: Apr. 4, 1989

[54] HAND HELD STEAM PRESSER

[75] Inventors: Karlheinz Frank, Offenbach am Main; Christoph Hanschke, Dreieich; Franz A. Stützer, Offenbach am Main, all of Fed. Rep. of Germany

[73] Assignee: Rowenta-Werke GmbH, Offenbach am Main, Fed. Rep. of Germany

[21] Appl. No.: 151,799

[22] Filed: Feb. 3, 1988

[30] Foreign Application Priority Data

Feb. 7, 1987 [DE] Fed. Rep. of Germany ..... 3703763

[51] Int. Cl.[4] ..... D06F 71/28

[52] U.S. Cl. ..... 38/15; 38/36

[58] Field of Search ..... 38/15, 36; 219/225; 223/52.1–52.6; 132/37 R

[56] References Cited

U.S. PATENT DOCUMENTS

| | | | |
|---|---|---|---|
| 4,009,367 | 2/1977 | Rizzuto | 219/225 X |
| 4,032,747 | 6/1977 | Kunz | 132/37 R X |
| 4,514,918 | 5/1985 | Warner | 38/36 |

FOREIGN PATENT DOCUMENTS 3417254 11/1985 Fed. Rep. of Germany .

*Primary Examiner*—Andrew M. Falik

[57] ABSTRACT

A hand-held steam brush, consisting of a support plate with steam holes which forms an outer wall of the hand-held steam brush. A pressure plate with steam exit holes is releasably secured to the support plate. The pressure plate, guided by hinged spacers, is movable towards the support plate counter to the pressure of a spring and can be fixedly connected to the support plate by means of a pressure plate locking device.

2 Claims, 1 Drawing Sheet

HAND HELD STEAM PRESSER

BACKGROUND OF THE INVENTION

1. Field of The Invention

The invention relates to a hand-held electric steam presser and, more particularly, a hand-held electric stream presser with a support plate which forms an outer wall of the hand-held steam presser and is provided with steam holes and accommodation for the mounting of brushes.

2. Description of Related Art

A hand-held electric stream brush having some of the attributes of this invention is known (German Patent No. 34 17 254). This appliance comprises a support plate which is connected to a steam producer. Water is conveyed from the tank into the electrically heated steam producer by means of a pump. The steam developed in the steam producer comes out of the steam holes provided in the support plate. By controlled directing of the steam, this appliance will remove crumples and creases very effectively from clothing. It is therefore ideal both for household use and also for travelling. On the support plate there are holders for removable brushes by means of which the range of application of the appliance can advantageously be extended. In spite of its many possible uses, the known hand-held steam brush cannot be used for pressing trouser creases, or for ironing pleats in skirts, blouses, skirts or the like. The users of the known hand-held steam brush are therefore obliged to take other appliances with them when they travel to enable them to look after their wardrobe properly, or else to make use of local services.

Starting from this known prior art, the aim of the invention is to extend the range of application of a hand-held steam brush.

SUMMARY OF THE INVENTION

Using a pressure plate releasably clamped to a support plate of the hand-held steam presser according to the invention can be used to press materials and fabrics or garments made from them, namely to put fresh creases in trousers, pleats in blouses, shirts and skirts or the like. However, it is also possible to refresh and renew the creases already in the materials. The range of application of a hand-held steam brush is substantially expanded by the invention. The pressure plate can be fixedly connected to the support plate by means of the pressure plate locking device. The pressure plate then forms a unit with the support plate. The steam generated in the appliance flows in controlled manner onto the material being treated, just as if the appliance had only a support plate, since the steam holes are arranged so as to register with the steam openings. In spite of the pressure plate the hand-held steam presser according to the invention may be used like the known hand-held steam brushes for refreshing and brushing garments. Brush holders provided on the pressure plate according to the invention can be used to secure a brush attachment to the outside of the pressure plate if the appliance is to be used as a brush. In order to press trouser creases, a pressure plate locking device is released. The pressure plate is lifted away from the support plate by a force of the compression spring. Rotatably mounted spacers, which are hinged to the support plate via the holder and directly to the pressure plate, cause a translatory movement of pressure plate. At the same time, between the support plate and the pressure plate, a gap, defined by the two plates, is formed having substantially parallel boundary surfaces which are defined as shown in FIG. 2 by a plurality of non parallel mating surfaces. The material or garment, e.g. trouser leg, which is to be pressed is placed in this gap. Then the two plates are pulled together using a handle and the jet of steam is released. In the area covered by the two plates, the material inserted is pressed smooth and the new crease is put in or the old crease is renewed, as desired. The pressure plate is releasably secured to the support plate. This makes it possible for hand-held steam brushes of the type already known to be fitted with the apparatus according to the invention.

BRIEF DESCRIPTION OF THE DRAWINGS

An embodiment by way of example of the invention is shown in the drawings and described more fully hereinafter.

In the drawings.

DESCRIPTION OF THE PREFERRED EMBODIMENT

Figure 1:
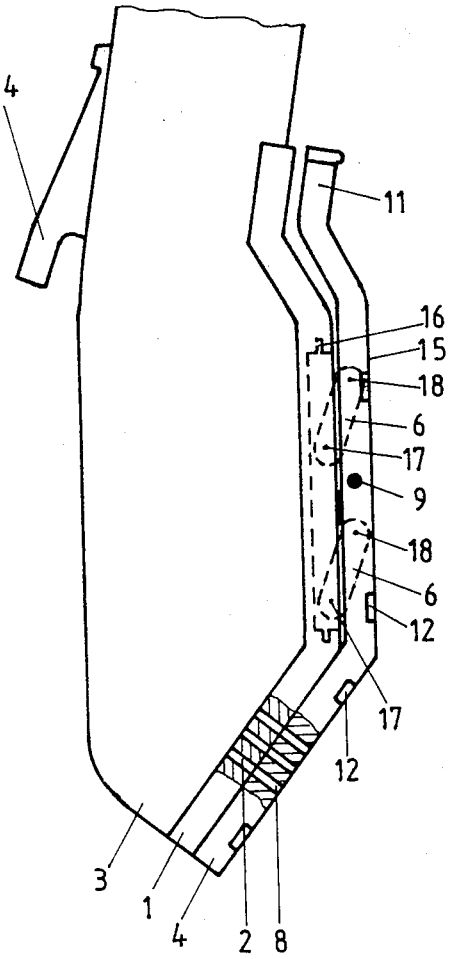
FIG. 1 shows the hand-held steam brush with the pressure plate according to the invention.
Figure 2:
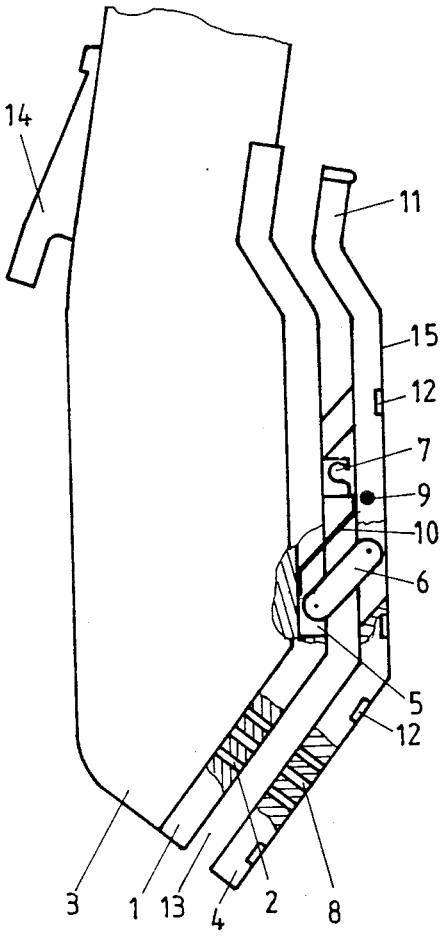
FIG. 2 shows the hand-held steam brush according to FIG. 1 with the pressure plate raised.

The hand-held steam brush shown consists of a support plate 1 with steam holes 2 and a covering hood 3 releasably secured to the support plate 1. A pressure plate 4 is releasably secured to the support plate 1. The pressure plate 4 is connected to the support plate 1 by a holder 5 which is releasably secured to the support plate 1 by means of a push-in connection 16. However, it is also possible to attach a frame-like holder to the support plate by screwing or by force fit. The holder 5 and the pressure plate 4 are effectively connected via the spacers 6 secured in the articulation points 17, 17, 18, 18. A pressure plate locking device 7 is arranged on the support plate 1. As shown in FIG. 1, the pressure plate 4 can be fixedly connected to the support plate 1 by means of the pressure plate locking device 7. The pressure plate 4 has steam openings 8 which, in this position, register with the steam holes 3 in the support plate 1. The locking device is releasable by means of the operating knob 9, and as a result the pressure plate 4 is lifted away from the support plate 1 by the spring 10 and the spacers 6 hinged thereto, thereby performing a translatory movement, as shown in FIG. 2.

In this position, a gap 13 with substantially parallel boundary surfaces is formed by the support plate 1 and pressure plate 4. For ironing, the garment which is to be pressed is inserted in this gap 13. Then the pressure plate 4 is pressed against the support plate 1 by means of a handle 11 provided on the pressure plate 4 and a controlled jet of steam is released by means of the button 14 in a manner similar, for example, to German Patent No. 3,417,254 which shows a steam generating apparatus, a steam channel and a steam release button to be generally known in the art of portable steam generating appliances. As a result, the garment inserted is ironed in the region of the plates 1 and 4. Brush holders 12 are provided on the outside 15 of the pressure plate 4 for securing brush attachments.

We claim:

1. A hand-held steam presser including a support plate having steam holes and forming an outer wall of said hand-held steam presser including;

(a) a pressure plate releasably fixed to said support plate for forming a gap between said support plate and said pressure plate for insertion of a wrinkled garmet therebetween the inside surfaces of the pressure plate and support plate comprising in a lengthwise direction a plurality of non planar mating surfaces, (b) said pressure plate containing steam openings, (c) said steam openings registering with said steam holes, (d) a holder connected to said support plate, (e) said holder and said pressure plate hinged together by at least a pair of spacers rotatable about articulation points, and (f) said pressure plate movable towards said support plate by a handle connected thereto against pressure applied by a spring.

2. A hand-held steam presser including a support plate having steam holes and forming an outer wall of said hand-held steam presser including;

(a) a pressure plate releasably fixed to said support plate for forming a gap between said support plate and said pressure plate for insertion of a wrinkled garment therebetween, the inside surfaces of the pressure plate and support plate comprising in a lengthwise direction a plurality of non planar mating surfaces, (b) said pressure plate containing steam openings, (c) said steam openings registering with said steam holes and (d) a locking device provided on said support plate for locking said pressure plate to said support plate.

* * * * *